US006964945B1

(12) United States Patent
Hartshorn et al.

(10) Patent No.: US 6,964,945 B1
(45) Date of Patent: Nov. 15, 2005

(54) SOLID DETERGENT COMPOSITIONS

(75) Inventors: Richard Timothy Hartshorn, Wylam (GB); Zayeed Alam, West Chester, OH (US); Kevin Norwood, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,454

(22) PCT Filed: Sep. 25, 1998

(86) PCT No.: PCT/US98/20221

§ 371 (c)(1),
(2), (4) Date: Jun. 12, 2001

(87) PCT Pub. No.: WO00/18869

PCT Pub. Date: Apr. 6, 2000

(51) Int. Cl.[7] ..... C11D 1/02; C11D 3/08

(52) U.S. Cl. ..... 510/507; 510/276; 510/315; 510/323; 510/351; 510/352; 510/357; 510/377; 510/424; 510/425; 510/428; 510/446; 510/532; 510/117; 510/443; 510/444

(58) Field of Search ..... 510/276, 315, 510/323, 351, 352, 357, 377, 424, 425, 428, 446, 507, 532, 117, 443, 444

(56) References Cited

U.S. PATENT DOCUMENTS 4,000,094 A * 12/1976 Fleming et al. ..... 252/557
4,123,377 A * 10/1978 Davey et al. ..... 252/103
4,125,370 A * 11/1978 Nicol ..... 8/137.5
4,208,295 A * 6/1980 Sai et al. ..... 252/94
4,243,544 A * 1/1981 Taylor ..... 252/135
4,265,777 A * 5/1981 Boyer et al. ..... 252/113
4,303,556 A * 12/1981 Llendado ..... 252/527
4,321,157 A * 3/1982 Harris et al. ..... 252/174.25
4,414,130 A * 11/1983 Cheng ..... 252/140
5,646,107 A 7/1997 Emery et al.
5,919,747 A 7/1999 Kazuta et al.

FOREIGN PATENT DOCUMENTS

| | | | |
|---|---|---|---|
| WO | WO 97/32952 | | 9/1997 |
| WO | WO 98/01520 | | 1/1998 |
| WO | 98/01520 | * | 1/1998 |
| WO | WO 00/18875 | | 4/2000 |

* cited by examiner

*Primary Examiner*—Charles Boyer
(74) *Attorney, Agent, or Firm*—Julia A. Glazer; Brahm J. Corstanje; Kim William Zerby

(57) ABSTRACT

The invention relates to solid detergent compositions comprising an aluminosilicate builder and an anionic surfactant and comprising (n) components (i), n being at least 2, whereby the level of aluminosilicate builder in said components together is at least 5% by weight of the composition and the level of the anionic surfactant in said components together is at least 5% by weight of the composition, and whereby the degree of mixture (M) of the anionic surfactant and the aluminosilicate builder is from 0 to 0.7, as defined in the description.

9 Claims, No Drawings

SOLID DETERGENT COMPOSITIONS

TECHNICAL FIELDS OF THE INVENTION

The invention relates to solid detergent compositions comprising aluminosilicate builder and surfactants comprised in two or more components which have an improved cleaning performance, an improved delivery to the wash and a reduced residue formation on the fabrics.

BACKGROUND TO THE INVENTION

All detergents on the market contain surfactants and builders. One of the most commonly used builders in phosphate-free detergents are alumninosilicates. They are inexpensive builders, which have as an additional benefit that they are easy to process. They are in fact useful process aids because they are very good structurants, binders or carrier materials for other detergent ingredients. Therefore, most detergents comprise a base powder made by spray-drying a slurry of aluminosilicate and surfactant or by agglomerating aluminosilicate and surfactant. Furthermore, aluminosilicates are useful as dusting agent, to reduce the stickiness or caking of the product.

A problem encountered with these detergents comprising a builder system containing aluminosilicates, it that they tend to cause fabric residues. These residues contain detergent products which is entrapped in the fabrics and/or are insoluble in water. They are noticeable by the consumer as spotting on the fabric.

Another problem encountered with, in particular solid, detergents is their tendency to gel upon contact with water. This leads to poor dispensing of the product from the dispensing drawer or from a dispensing device, and also to poor dissolution of the product into the wash water. This results in residues in the drawer, dispensing device, washing machine and on the fabrics, which may be noticeable as spots on the fabric. It has been found that in particular surfactants gel upon contact with water.

The inventors have now surprisingly found that this problems in particular arises when the surfactants and the aluminosilicates in the detergent are in close contact with one another, for example when they are in the detergent in an intimately mixture. This is for example the case in most known and used base powders, which are agglomerates or spray-dried powders containing. The inventors have now found that the residue formation problem but also the gelling problem or dissolution or dispensing problem mainly arises in most known products, when about all the anionic surfactants and aluminosilicates are intimately mixed with one another. When the degree of intimate mixing is reduced or even avoided completely, they have found that these problems are reduced or even solved completely.

Thus, the inventors have found a solution which still allows the incorporation of aluminosilicates and surfactants in detergent, but in a different manner: the invention provides thereto detergents comprising at least two components comprising the surfactants and the aluminosilicate in such a manner that a limited degree of intimate mixing occurs.

The detergents of the invention have a reduced fabric residue, in particular of insoluble detergent ingredients, gelling, an improved dispensing and dissolution. It has been found that these benefits are obtained by any convention way of introducing detergent to the wash, including by use of a dispensing drawer, a dispensing device or by addition of the detergent in the washing prior to addition of the wash load or addition of the detergent on top of the wash load.

The compositions may comprise an effervescence system to further aid the dispensing or dissolution or foaming.

SUMMARY OF THE INVENTION

The invention provides a detergent composition comprising an aluminosilicate builder and an anionic surfactant and comprising (n) components (i), n being at least 2, whereby the level of aluminosilicate builder in said components together is at least 5% by weight of the composition and the level of the anionic surfactant in said components together is at least 5% by weight of the composition, and whereby the degree of mixture (M) of the anionic surfactant and the aluminosilicate builder is from 0 to 0.7, M being $$\Sigma^{n}_{i-1}\sqrt{(\sigma_i \cdot \zeta_i)}$$

$\sigma$ is the fraction of the anionic surfactant of the composition comprised in component (i); $\zeta$ is the fraction of the aluminosilicate of the composition comprised in component (i).

The composition is in particular in granular form, in the form of an extrudate, marumerate or pastille, or in the form of an tablet.

The invention also relates to the use in a detergent composition of at least two components which comprise together an aluminosilicate at a level of at least 5% by weight of the composition and an anionic surfactant at a level of at least 5% by weight of the composition or mixtures thereof, whereby the degree of mixture (M) of the anionic surfactant and the aluminosilicate builder is from 0 to 0.7 for improvement of the delivery of the detergent to the washing water, M being as defined above.

The detergent compositions have an improved delivery to the washing water. This means for the purpose of the invention that the compositions provide a reduction of fabric residues, in particular of water-insoluble detergent ingredients such as the aluminosilicate, an improvement of the dispensing of the detergent composition, an improvement in the dissolution of the detergent, a reduction in gelling of the detergent and/or a reduction of lump formation of the detergent on the fabrics and for bleach-containing compositions, an reduced risk of fabric damage.

DETAILED DESCRIPTION OF THE INVENTION

The detergent composition herein comprise at least two components which comprise an anionic surfactant or an aluminosilicate or mixtures thereof, whereby if mixtures of aluminosilicate and the surfactant are present in one or more of the components, the degree of mixture M is less than 0.7, as defined by the formula. Thus, each component comprises part or all of the aluminosilicate, all or part of the anionic surfactant or mixtures thereof, provided that M is from 0 to 0.7.

The components of the detergent composition of the invention comprise each at least two ingredients, including the anionic surfactant and/or the aluminosilicate, which are intimately mixed. This means for the purpose of the invention that the two or more ingredients the component are substantially homogeneously divided in the component.

Preferably, a component is such that when it comprises an anionic surfactant, the level of the anionic surfactant is less than 95%, preferably less than 85% or even less than 80% by weight of the component, whereby it may be preferred that the level of the anionic surfactant is at least 5%, preferably at least 10% more preferably at least 20% or even at least 30% or even 35% by weight of the component.

Preferably, a component is such that when it comprises an aluminosilicate, the level of the aluminosilicate is less than 95%, preferably less than 85% or even less than 80% by weight of the component, whereby it may be preferred that the level of the aluminosilicate is at least 5%, preferably at least 10% by weight of the component.

It should be understood that the detergent composition herein may also comprise additional intimately mixtures which are free of anionic surfactant and free of aluminosilicate. Also, the detergent composition may comprise additional ingredients which are not in an intimate mixture with another ingredient and thus not comprised in a component of the composition, as defined herein. For example, the composition may comprise a detergent ingredient sprayed onto the components herein or dry-added to the components herein.

The components together comprise the aluminosilicate builder at a level of least 5% by weight of the composition of and the anionic surfactant at a level of at least 5% by weight of the composition. Preferably, the components comprise the aluminosilicate at a level of at least 7%, or more preferably at least 10% or even 15% by weight of the composition. Depending on the precise formulation of the composition and the conditions of use, the compositions of the invention can even comprise higher levels of aluminosilicate, such as more than 20% or even more than 25%, whilst still providing an improved delivery of the detergent to the wash.

Preferably at least 7% or more preferably at least 10% or even at least 12% by weight of the composition of anionic surfactant is present in the components. Depending on the precise formulation of the composition and the conditions of use, it may be preferred to have levels of anionic surfactants of 18% by weight of the composition or more.

It may be preferred that the detergent composition comprises additional dry-added aluminosilicate, in particular to dust the detergent components to reduce the risk of caking and/or to provide whiteness to the product.

Preferably, M is less than 0.65, or even less than 0.45 or even 0.4 or even 0.35. It may be preferred that M is 0, and that thus no components are present in the detergent composition which comprise both aluminosilicate and anionic surfactants. Whether this is preferred will for example depend the levels of aluminosilicate and anionic surfactant in the detergent, on the other ingredients present in the formulation and the amount of components present in the formulation.

The components herein preferably are particles, having a particle size of at least 50 microns, preferably the particles have an weight average particle size of more than 150 or more than 250 microns or even more than 350 microns, as measured by sieving the composition on sieves of different mesh size, and calculating the fraction which remain on the sieve and the fraction which passes through the sieve.

It may be preferred that at least one component is made by a spray-drying process, as known in the art, and at least one component is made by an agglomeration process, as known in the art.

Preferably, the density of the components is from 250 g/liter to 1500 g/liter, more preferably at least one of the components, preferably all of the components, has a density from 400 g/liter to 1200 g/liter, more preferably from 500 g/liter to 900 g/liter.

A highly preferred additional ingredient of the detergent compositions herein may be oxygen based bleach, preferably containing an hydrogen peroxide source, preferably a perhydrogen compound and a bleach activator, described herein after. It has been found that the improved product delivery to the wash results in an improved delivery of the bleach system therein, which reduces the risk of deposition of bleach on the fabric and the risk of patchy fabric damage.

Another preferred additional ingredient is one or more additional builder materials, such as one or more monomeric, oligomeric or polymeric carboxylate builders and/or crystalline layered silicate builder material, described herein after.

Also, depending on the use of the composition and the specific formulation, the detergent composition may be substantially free of specific spray-on nonionic alkoxylated alcohol surfactants, which have been found to cause gelling or dispensing or dissolution problems. It may then be preferred that the composition comprises other nonionic surfactants, preferably nonionic surfactants which are solid at room temperature. A further advantage can be that the omission of sprayed-on nonionic alkoxylated alcohols allows the reduction or omission of powdered materials normally required to dust the detergent particles containing these liquid nonionic surfactants, such as fine aluminosilicates. This not only reduces the process complexity, but moreover reduces the degree of mixing or contact of the s and surfactants.

Furthermore, the inventors have found that in certain embodiments of the invention it may be beneficial to reduce the degree of mixing between the aluminosilicate and one or more of the organic polymeric compounds, when present, for example flocculation polymers and polycarboxylate polymers, as described herein. The degree of mixture of the aluminosilicate and one or more of these polymers can be determined by the formula above, wherein a would indicate the weight fraction of the specific polymer in a certain component. It has been found that this may reduce the fabric residue formation on the fabrics, in particular of water-insoluble components, such as the aluminosilicate.

It may also be useful that in certain embodiments of the invention, the degree of mixing between amorphous silicate and an anionic surfactant is reduced, when an amorphous silicate is present, in particular in mixtures containing anionic surfactant which are to be spray-dried, it may be beneficial to reduce the amount of silicate present, for example to levels of less than 3% by weight of the mixture, or even less than 2%, or even less than 1% or even 0% by weight of the mixture.

Aluminosilicate

Suitable aluminosilicates herein are zeolites which have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicates are in preferably in hydrated form and are preferably crystalline, containing from 10% to 28%, more preferably from 18% to 22% water in bound form. However, it may be useful to incorporate overdried aluminosilicates.

The aluminosilicates can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}]$. 276 $H_2O$.

Anionic Surfactant

Any anionic surfactant can be incorporated in the compositions of the invention. The anionic surfactant herein preferably comprises at least a sulphate surfactant and/or a sulphonate surfactant or mixtures thereof. It may be preferred that the anionic surfactant comprises only alkyl sulphonate surfactant or optionally combined with fatty acids or soap salts thereof. Alternatively, it may be preferred that the composition comprises only akly sulphate surfactant, but hereby it is preferred that at least a mid-chain branched alkyl surfactant is present or at least two alkyl surfactants are present.

Depending on the precise formulation of the composition and the use thereof, it may be preferred that the compositions herein comprise a particulate component, as described above, preferably in the form of a flake of an alkyl sulfate or sulphonate surfactant, preferably an alkyl benzene sulphonate, present at a concentration of from 85% to 95% of the particle or flake, the balance being an sulfate salt and moisture, the particle or flake being admixed to the other detergent component(s) or ingredients.

Other possible anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulphonate Surfactant

The anionic sulphonate surfactants in accordance with the invention include the salts of $C_5$–$C_{20}$ linear or branched alkylbenzene sulphonates, alkyl ester sulphonates, $C_6$–$C_{22}$ primary or secondary alkane sulphonates, $C_6$–$C_{24}$ olefin sulphonates, sulphonated polycarboxylic acids, and any mixtures thereof.

Highly preferred is a C12–C16 linear alkylbenzene sulphonate. Preferred salts are sodium and potassium salts.

The alkyl ester sulphonated surfactant are also suitable for the invention, preferably those of formula $$R^1—CH(SO_3M)\text{-}(A)_x—C(O)—OR^2$$

wherein $R^1$ is a $C_6$–$C_{22}$ hydrocarbyl, $R^2$ is a $C_1$–$C_6$ alkyl, A is a $C_6$–$C_{22}$ alkylene, alkenylene, x is 0 or 1, and M is a cation. The counterion M is preferably sodium, potassium or ammonium.

The alkyl ester sulphonated surfactant is preferably a α-sulpho alkyl ester of the formula above, whereby thus x is 0. Preferably, $R^1$ is an alkyl or alkenyl group of from 10 to 22, preferably 16 C atoms and x is preferably 0. $R^2$ is preferably ethyl or more preferably methyl.

It can be preferred that the R1 of the ester is derived from unsaturated fatty acids, with preferably 1, 2 or 3 double bonds. It can also be preferred that $R^1$ of the ester is derived from a natural occurring fatty acid, preferably palmic acid or stearic acid or mixtures thereof.

Anionic Alkyl Sulphate Surfactant

The anionic sulphate surfactant herein include the linear and branched primary and secondary alkyl sulphates and disulphates, alkyl ethoxysulphates having an average ethoxylation number of 3 or below, fatty oleoyl glycerol sulphates, alkyl phenol ethylene oxide ether sulphates, the $C_5$–$C_{17}$ acyl-N—($C_1$–$C_4$ alkyl) and —N—($C_1$–$C_2$ hydroxyalkyl) glucamine sulphates, and sulphates of alkylpolysaccharides.

Primary alkyl sulphate surfactants are preferably selected from the linear and branched primary $C_{10}$–$C_{18}$ alkyl sulphates, more preferably the $C_{11}$–$C_{15}$ linear or branched chain alkyl sulphates, or more preferably the $C_{12}$–$C_{14}$ linear chain alkyl sulphates.

Preferred secondary alkyl sulphate surfactant are of the formula $$R^3—CH(SO_4M)—R^4$$

wherein $R^3$ is a $C_8$–$C_{20}$hydrocycarbyl, $R^4$ is a hydrocycarbyl and M is a cation.

Alkyl ethoxy sulphate surfactants are preferably selected from the group consisting of the $C_{10}$–$C_{18}$ alkyl sulphates which have been ethoxylated with from 0.5 to 3 moles of ethylene oxide per molecule. More preferably, the alkyl ethoxysulphate surfactant is a $C_{11}$–$C_{18}$, most preferably $C_{11}$–$C_{15}$ alkyl sulphate which has been ethoxylated with from 0.5 to 3, preferably from 1 to 3, moles of ethylene oxide per molecule.

A particularly preferred aspect of the invention employs mixtures of the preferred alkyl sulphate and alkyl ethoxysulphate surfactants. Preferred salts are sodium and potassium salts.

Mid-Chain Branched Anionic Surfactants

Preferred mid-chain branched primary alkyl sulfate surfactants for use herein are of the formula $$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M.$$

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In the surfactant system comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

R, $R^1$, and $R^2$ are each independently selected from hydrogen and $C_1$–$C_3$ alkyl group (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

M is hydrogen or a salt forming cation depending upon the method of synthesis. w is an integer from 0 to 13; x is an integer from 0 to 13; y is an integer from 0 to 13; z is an integer of at least 1; and w+x+y+z is an integer from 8 to 14.

A preferred mid-chain branched primary alkyl sulfate surfactant is, a C16 total carbon primary alkyl sulfate surfactant having 13 carbon atoms in the backbone and having 1, 2, or 3 branching units (i.e., R, $R^1$ and/or $R^2$) of in total 3 carbon atoms, (whereby thus the total number of carbon atoms is at least 16). Preferred branching units can be one propyl branching unit or three methyl branching units.

Another preferred surfactant are branched primary alkyl sulfates having the formula

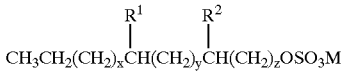

wherein the total number of carbon atoms, including branching, is from 15 to 18, and when more than one of these sulfates is present, the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11; y is from 0 to 11; z is at least 2; and x+y+z is from 9 to 13; provided $R^1$ and $R^2$ are not both hydrogen.

Dianionic Surfactants

The dianionic surfactants are also useful anionic surfactants for the present invention, in particular those of formula

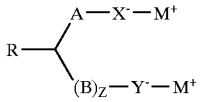

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A nad B are independently selected from alkylene, alkenylene, (poly) alkoxylene, hydroxyalkylene, arylalkylene or amido alkylene groups of chain length $C_1$ to $C_{28}$ preferably $C_1$ to $C_5$, most preferably $C_1$ or $C_2$, or a covalent bond, and preferably A and B in total contain at least 2 atoms; A, B, and R in total contain from 4 to about 31 carbon atoms; X and Y are anionic groups selected from the group comprising carboxylate, and preferably sulfate and sulfonate, z is 0 or preferably 1; and M is a cationic moiety, preferably a substituted or unsubstituted ammonium ion, or an alkali or alkaline earth metal ion.

The most preferred dianionic surfactant has the formula as above where R is an alkyl group of chain length from $C_{10}$ to $C_{18}$, A and B are independently $C_1$ or $C_2$, both X and Y are sulfate groups, and M is a potassium, ammonium, or a sodium ion.

Preferred dianionic surfactants herein include:

(a) 3 disulphate compounds, preferably 1,3 C7–C23 (i.e., the total number of carbons in the molecule) straight or branched chain alkyl or alkenyl disulphates, more preferably having the formula:

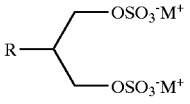

wherein R is a straight or branched chain alkyl or alkenyl group of chain length from about $C_4$ to about $C_{20}$;

(b) 1,4 disulphate compounds, preferably 1,4 C8–C22 straight or branched chain alkyl or alkenyl disulphates, more preferably having the formula:

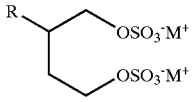

wherein R is a straight or branched chain alkyl or alkenyl group of chain length from about $C_4$ to about $C_{18}$; preferred R are selected from octanyl, nonanyl, decyl, dodecyl, tetradecyl, hexadecyl, octadecyl, and mixtures thereof; and (c) 1,5 disulphate compounds, preferably 1,5 C9–C23 straight or branched chain alkyl or alkenyl disulphates, more preferably having the formula:

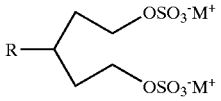

wherein R is a straight or branched chain alkyl or alkenyl group of chain length from about $C_4$ to about $C_{18}$.

It can be preferred that the dianionic surfactants of the invention are alkoxylated dianionic surfactants.

The alkoxylated dianionic surfactants of the invention comprise a structural skeleton of at least five carbon atoms, to which two anionic substituent groups spaced at least three atoms apart are attached. At least one of said anionic substituent groups is an alkoxy-linked sulphate or sulphonate group. Said structural skeleton can for example comprise any of the groups consisting of alkyl, substituted alkyl, alkenyl, aryl, alkaryl, ether, ester, amine and amide groups. Preferred alkoxy moieties are ethoxy, propoxy, and combinations thereof.

The structural skeleton preferably comprises from 5 to 32, preferably 7 to 28, most preferably 12 to 24 atoms. Preferably the structural skeleton comprises only carbon-containing groups and more preferably comprises only hydrocarbyl groups. Most preferably the structural skeleton comprises only straight or branched chain alkyl groups.

The structural skeleton is preferably branched. Preferably at least 10% by weight of the structural skeleton is branched and the branches are preferably from 1 to 5, more preferably from 1 to 3, most preferably from 1 to 2 atoms in length (not including the sulphate or sulphonate group attached to the branching).

A preferred alkoxylated dianionic surfactant has the formula

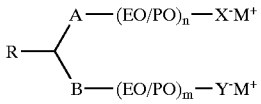

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from, optionally substituted, alkyl and alkenyl group of chain length $C_1$ to $C_{28}$, preferably $C_1$ to $C_5$, most preferably $C_1$ or $C_2$, or a covalent bond; EO/PO are alkoxy moieties selected from ethoxy, propoxy, and mixed ethoxy/propoxy groups, wherein n and m are independently within the range of from about 0 to about 10, with at least m or n being at least 1; A and B in total contain at least 2 atoms; A, B, and R in total contain from 4 to about 31 carbon atoms; X and Y are anionic groups selected from the group consisting of sulphate and sulphonate, provided that at least one of X or Y is a sulfate group; and M is a cationic moiety, preferably a substituted or unsubstituted ammonium ion, or an alkali or alkaline earth metal ion.

The most preferred alkoxylated dianionic surfactant has the formula as above where R is an alkyl group of chain length from $C_{10}$ to $C_{18}$, A and B are independently $C_1$ or $C_2$, n and m are both 1, both X and Y are sulfate groups, and M is a potassium, ammonium, or a sodium ion.

Preferred alkoxylated dianionic surfactants herein include: ethoxylated and/or propoxylated disulphate compounds, preferably C10–C24 straight or branched chain alkyl or alkenyl ethoxylated and/or propoxylated disulphates, more preferably having the formulae:

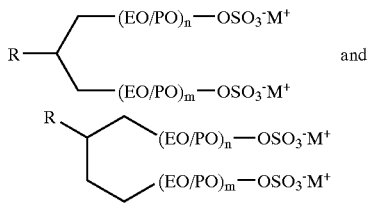

wherein R is a straight or branched chain alkyl or alkenyl group of chain length from about C6 to about $C_{18}$; EO/PO are alkoxy moieties selected from ethoxy, propoxy, and mixed ethoxy/propoxy groups; and n and m are independently within the range of from about 0 to about 10 (preferably from about 0 to about 5), with at least m or n being 1.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2C00^{-M+}$ wherein R is a $C_6$ to $C_8$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressors.

Alkali Metal Sarcosinate Surfactant

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Effervescence System

Any effervescence system known in the art can be used in the composition of the invention. A preferred effervescence system comprises an acid source, capable of reacting with an alkali source in the presence of water to produce a gas.

The acid source is preferably present at a level of from 0.5% to 35%, more preferably from 1.0% or even 2% to 20% or even form 4% to 20% by weight of the composition.

It may be preferred that the acid source or part thereof and the alkali source or part thereof are comprised in an intimate mixture, for example in the form of a compacted particle. The molecular ratio of the acid source to the alkali source, is preferably from 50:1 to 1:50, more preferably from 20:1 to 1:20 more preferably from 10:1 to 1:10, whereby when an intimate mixture of the acid source and the alkali source is present, this ratio is more preferably from 5:1 to 1:3, more preferably from 3:1 to 1:2, more preferably from 2:1 to 1:2.

The acid source component may be any organic, mineral or inorganic acid, or a derivative thereof, or a mixture thereof. Preferably the acid source component comprises an organic acid.

The acid compound is preferably substantially anhydrous or non-hygroscopic and the acid is preferably water-soluble. It may be preferred that the acid source is overdried.

Suitable acids source components include citric, malic, maleic, fumaric, aspartic, glutaric, tartaric succinic or adipic acid, monosodium phosphate, boric acid, or derivative thereof. Citric acid, maleic or malic acid are especially preferred.

Most preferably, the acid source provides acidic compounds which have an average particle size in the range of from about 75 microns to 1180 microns, more preferably from 150 microns to about 710 microns, calculated by sieving a sample of the source of acidity on a series of Tyler sieves.

As discussed above, the effervescence system preferably comprises an alkali source, however, for the purpose of the invention, it should be understood that the alkali source may be part of the effervescence particle or can be part of the cleaning composition comprising the particle, or can be present in the washing liquor, whereto the particle or the cleaning composition is added.

Any alkali source which has the capacity to react with the acid source to produce a gas may be present in the particle, which may be any gas known in the art, including nitrogen oxygen and carbondioxide gas. Preferred can be perhydrate bleaches, including perborate, and silicate material. The alkali source is preferably substantially anhydrous or non-hydroscopic. It may be preferred that the alkali source is overdried.

Preferably this gas is carbon dioxide, and therefore the alkali source is a preferably a source of carbonate, which can be any source of carbonate known in the art. In a preferred embodiment, the carbonate source is a carbonate salt. Examples of preferred carbonates are the alkaline earth and alkali metal carbonates, including sodium or potassium carbonate, bicarbonate and sesqui-carbonate and any mixtures thereof with ultra-fine calcium carbonate such as are disclosed in German Patent Application No. 2,321,001 published on Nov. 15, 1973. Alkali metal percarbonate salts are also suitable sources of carbonate species, which may be present combined with one or more other carbonate sources.

The carbonate and bicarbonate preferably have an amorphous structure. The carbonate and/or bicarbonates may be coated with coating materials. It can be preferred that the particles of carbonate and bicarbonate can have a mean particle size of 75 microns or preferably 150 μm or greater, more preferably of 250 μm or greater, preferably 500 μm or greater. It may be preferred that the carbonate salt is such that fewer than 20% (by weight) of the particles have a particle size below 500 μ, calculated by sieving a sample of the carbonate or bicarbonate on a series of Tyler sieves. Alternatively or in addition to the previous carbonate salt, it may be preferred that the fewer than 60% or even 25% of the particles have a particle size below 150 μm, whilst fewer than 5% has a particle size of more than 1.18 mm, more preferably fewer than 20% have a particle size of more than 212 μm, calculated by sieving a sample of the carbonate or bicarbonate on a series of Tyler sieves.

Additional Ingredients

The compositions herein may contain additional detergent components. The precise nature of these additional components, and levels of incorporation thereof will depend on the physical form of the compositions comprising the builder component and the precise nature of the washing operation for which it is to be used.

Additional ingredients include additional builders, additional surfactants, bleach, enzymes, suds suppressors, lime soap, dispersants, soil suspension and anti-redeposition agents soil releasing agents, perfumes, brightners, photobleaching agents and additional corrosion inhibitors.

Water-Soluble or Partially Water-Soluble Builders

The composition preferably comprises one or more water-soluble or partially water-soluble builders.

These include crystalline layered silicates an organic carboxylates or carboxylic acids. The preferred crystalline layered silicate herein have the general formula $$NaMSi_x0_{2x+1}.yH_20$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. M is preferably H, K or Na or mixtures thereof, preferably Na. The most preferred material is $\alpha$-$Na_2Si_20_5$, $\beta Na_2Si_20_5$ or $\delta Na_2Si_20_5$, or mixtures thereof, preferably being at least 75% —$Na_2Si_20_5$, for example available from Clariant as NaSKS-6.

The crystalline layered silicate material, in particular of the formula $Na_2Si_20_5$ may optionally comprise other elements such as B, P, S, for example obtained by processes as described in EP 578986-B.

The crystalline layered silicate may be in an intimate mixture with other materials, including one or more of surfactants of the surfactant system herein. Preferred other materials are other water-soluble builders, including (poly) carboxylic acids and salts thereof, including polymeric compounds such as acrylic and/or maleic acid polymers, inorganic acids or salts, including carbonates and sulphates, or small levels of other silicate material, including amorphous silicate, meta silicates, and aluminosilicates, as described herein.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms and mixtures of any of the foregoing.

The carboxylate or polycarboxylate builder can be monomeric or oligomeric in type although monomeric polycarboxylates are generally preferred for reasons of cost and performance. In addition to these water-soluble builders, polymeric polycarboxyltes may be present, including homo and copolymers of maleic acid and acrylic acid and their salts.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates.

Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

Most preferred may be citric acid, malic acid, and fumaric acid, or their salts or mixtures thereof.

The parent acids of the monomeric or oligomeric polycarboxylate chelating agents or mixtures thereof with their salts, e.g. citric acid or citrate/citric acid mixtures, are also contemplated as useful builder components.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$ –$C_{18}$ alkyl dimethylamine oxide, and $C_{10}$–$C_{18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$wherein R is a $C_6$–$C_{18}$ hydrocarbyl group, each $R^1$ is typically $C_1$–$C_3$ alkyl, and $R^2$ is a $C_1$—$C_5$ hydrocarbyl group. Preferred betaines are $C_{12}$–$C_{18}$ dimethyl-ammonio hexanoate and the $C_{10}$–$C_{18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Monoalkoxylated Amine Surfactants

Highly preferred herein are cationic mono-alkoxylated amine surfactant preferably of the general formula I:

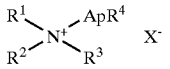

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

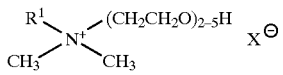

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-Alkoxylated Amine Surfactant

The cationic bis-alkoxylated amine surfactant preferably has the general formula II:

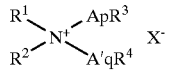

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

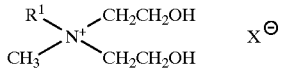

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $ApR^4$ are each monoethoxy.

Other cationic bis-alkoxylated amine surfactants useful herein include compounds of the formula:

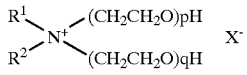

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

A highly preferred additional components of the compositions herein is an oxygen bleach, preferably comprising a hydrogen peroxide source and a bleach precursor or activator.

A prferred source of hydrogen peroxide is a perhydrate bleach, such as metal perborates, more preferably metal percarbonates, particularly the sodium salts. Perborate can be mono or tetra hydrated. Sodium percarbonate has the formula corresponding to $2Na_2CO_3.3H_2O_2$, and is available commercially as a crystalline solid.

In particular the percarbonate salts are preferably coated. Suitable coating agent are known in the art, and include silicates, magnesium salts and carbonates salts.

Potassium peroxymonopersulfate, sodium per is another optional inorganic perhydrate salt of use in the detergent compositions herein.

Organic Peroxyacid Bleaching System

A preferred feature of the composition herein is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

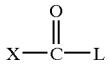

where L is a leaving group and X is essentially any functionality, such that on perhydroloysis the structure of the peroxyacid produced is

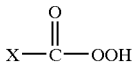

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

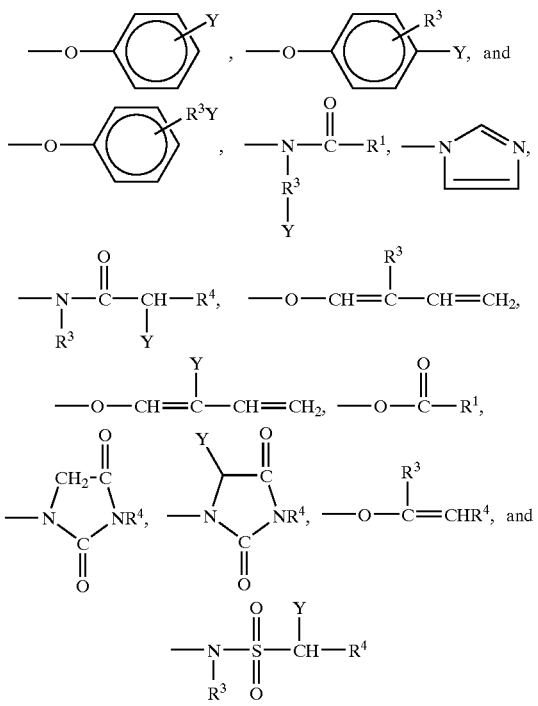

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^-$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N—N, $N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Plkyl Peroxyacid Precursors

Amide substituted alkyl peroxyacid precursor compounds are suitable herein, including those of the following general formulae:

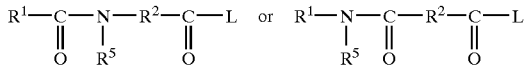

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The detergent composition may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

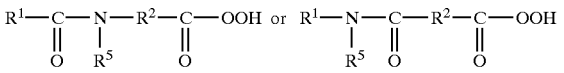

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid Mono- and diperazelaic acid, mono- and diperbrassylic acid and N-phthaloylaminoperoxicaproic acid are also suitable herein.

Heavy Metal Ion Sequestrant

Heavy metal ion sequestrant are also useful additional ingredients herein. By heavy metal ion sequestrant it is meant herein components which act to sequester (chelate) heavy metal ions. These components may also have a limited calcium and magnesium chelation capacity, but preferentially they show selectivity to binding heavy metal ions such as iron, manganese and copper. The are thus not considered builders for the purpose of the invention.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Organic Polymeric Compound

Organic polymeric compounds are preferred additional components of the compositions herein.

By organic polymeric compound it is meant herein essentially any polymeric organic compound commonly used as binder, dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

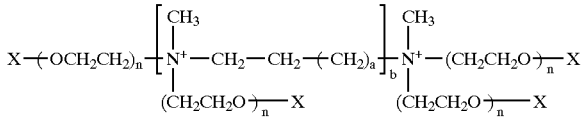

an wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. Nos. 4,659,802 and 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$—$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10, preferably 1% to 10% by weight; a particularly preferred silicone glycol rake copolymer of this type is DCO544, commercially available from DOW Coming under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners, as known in the art.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course; forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylenelpolyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct.

27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo K K.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes, speckles, colours or dyes, filler salts, with sodium sulfate being a preferred filler salt.

Also, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by (reference), can be present.

Highly preferred are encapsulated perfumes, preferably comprising a starch encapsulte.

In the compositions of the invention, it may be preferred that when dyes and/or perfumes are sprayed onto the another component, the component does not comprise spray-on nonionic alkoxylated alcohol surfactant.

Form of the Compositions

The composition of the invention thereof can be made via a variety of methods involving the mixing of ingredients, including dry-mixing, compaction such as agglomerating, extrusion, tabletting, or spray-drying of the various compounds comprised in the detergent component, or mixtures of these techniques, whereby the components herein also can be made by for example compaction, including extrusion and agglomerating, or spray-drying.

The compositions herein can take a variety of physical solid forms including forms such as tablet, flake, pastille and bar, and preferably the composition is in the form of granules or a tablet.

The compositions in accord with the present invention can also be used in or in combination with bleach additive compositions, for example comprising chlorine bleach.

The compositions preferably have a density of more than 350 gr/liter, more preferably more than 450 gr/liter or even more than 570 gr/liter.

Abbreviations used in Examples

In the detergent compositions, the abbreviated component identifications have the following meanings:

| | |
|---|---|
| LAS | Sodium linear $C_{11-13}$ alkyl benzene sulfonate |
| LAS (I) | Flake containing sodium linear $C_{11-13}$ alkyl benzene sulfonate (90%) and sodium sulphate and moisture |
| LAS(II) | Potassium linear $C_{11-13}$ alkyl benzene sulfonate |
| MES | α-sulpho methylester of $C_{18}$ fatty acid |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$–$C_{22}$ alkyl disulfate of formula 2-(R).$C_4$ $H_7$.-1,4-$(SO_4-)_2$ where R = $C_{10}$–$C_{18}$ |
| SADE2S | Sodium $C_{14}$–$C_{22}$ alkyl disulfate of formula 2-(R).$C_4$ $H_7$.-1,4-$(SO_4-)_2$ where R = $C_{10}$–$C_{18}$, condensed with z moles of ethylene oxide |
| APA | $C_8$–$C_{10}$ amino propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 (I) | Crystalline layered silicate of formula δ-$Na_2Si_2O_5$ of weight average particle size of 18 microns and at least 90% by weight being of particle size of below 65.6 microns. |
| NaSKS-6 (II) | Crystalline layered silicate of formula δ-$Na_2Si_2O_5$ of weight average particle size of 18 microns and at least 90% by weight being of particle size of below 42.1 microns. |
| Citric acid | Anhydrous citric acid |
| Borate | Sodium borate |
| Carbonite | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |

-continued

| | |
|---|---|
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |

-continued

| | |
|---|---|
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photoactivated bleach | Sulfonated zinc phthlocyanine or sulfonated alumino phthlocyanine encapsulated in or carried by a soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-y1)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethyoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | $bis((C_2H_5O)(C_2H_4O)_n)(CH_3)\text{-}N^+\text{-}C_6H_{12}\text{-}N^+\text{-}(CH_3)\ bis((C_2H_5O)\text{-}(C_2H_4O))_n$, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |

EXAMPLE I

| | A | B | C | D | E | F | G | H | I |
|---|---|---|---|---|---|---|---|---|---|
| Blown powder | | | | | | | | | |
| LAS | 5.0 | 8.0 | 3.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS | — | — | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | — | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |

-continued

| | A | B | C | D | E | F | G | H | I |
|---|---|---|---|---|---|---|---|---|---|
| Agglomerate | | | | | | | | | |
| LAS | | | — | — | — | — | — | 2.0 | — |
| MBAS | | | — | — | — | — | 2.0 | — | 1.0 |
| $C24AE_3$ | | | — | — | — | — | — | 1.0 | 0.5 |
| Carbonate | | | — | — | — | 1.0 | 1.0 | 1.0 | — |
| Sodium citrate | | | — | — | — | — | — | — | 5.0 |
| CFAA | | | | | — | 2.0 | — | — | 2.0 |
| QAS | | | — | — | — | 1.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 10.0 | 26.0 | 15.0 | 16.0 |
| Sodium silicate | | | — | — | — | — | — | — | — |
| PEG | — | — | — | — | — | — | 4.0 | — | — |
| Agglomerates | | | | | | | | | |
| SKS-6 | 6.0 | 8.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/ bicarbonate (40:20:40) | 8.0 | 10.0 | 10.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (I) | 10.0 | 10.0 | 10.0 | — | — | — | 12.0 | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Zeolite A | — | — | — | 10.0 | 10.0 | — | — | — | — |
| Carbonate | 0.0 | 10.0 | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carboanate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

EXAMPLE 2

The following are detergent formulations according to the present invention:

| | J | K | L | M |
|---|---|---|---|---|
| Blown Powder | | | | |
| Zeolite A | 12.0 | 20.0 | — | — |
| Sodium sulfate | — | 5.0 | 2.0 | — |
| LAS | — | 10.0 | 3.0 | — |
| C45AS | — | 4.0 | 4.0 | — |

-continued

| | J | K | L | M |
|---|---|---|---|---|
| QAS | — | — | 1.5 | — |
| DTPA/HEDP/EDDS | 0.4 | 0.4 | 0.4 | — |
| CMC | 0.4 | 0.4 | 0.4 | — |
| Carbonate | — | — | 3.0 | |
| AA or MA/AA | 4.0 | 2.0 | 10.0 | — |
| Agglomerates | | | | |
| QAS | 1.0 | — | — | — |
| LAS | 1.0 | — | 2.0 | 10.0 |
| TAS | — | — | — | 1.0 |

-continued

| | J | K | L | M |
|---|---|---|---|---|
| Silicate | 1.0 | — | — | 0.3 |
| Zeolite A | 8.0 | — | 8.0 | 3.0 |
| Carbonate | 8.0 | — | 4.0 | 3.0 |
| Agglomerate | | | | |
| NaSKS-6 | 15.0 | 12.0 | — | 10.0 |
| LAS | 8.0 | 13.0 | — | 8.0 |
| AS | 5.0 | — | — | |
| Spray On | | | | |
| Perfume | 0.3 | 0.3 | 0.3 | 0.5 |
| Brightener | 0.01 | 0.01 | 0.01 | 0.01 |
| C25E5 | 2.0 | — | 1.0 | — |
| Dry additives | | | | |
| LAS (I) | — | — | 7.0 | — |
| QEA | 1.0 | 0.5 | 0.5 | 0.5 |
| Citrate | — | — | 10.0 | — |
| Bicarbonate | — | 3.0 | — | |
| Carbonate | 8.0 | 15.0 | 10.0 | |
| NAC OBS | 4.0 | — | — | — |
| TAED | 2.0 | — | 0.3 | 5.0 |
| NOBS | — | 2.0 | 3.0 | |
| PC/PB1 | 14.0 | 3.0 | 3.0 | 18.0 |
| PEG | — | — | 0.9 | 0.5 |
| Soap | — | 0.5 | — | — |
| Malic acid | 7.0 | — | — | — |
| Zeolite A | 2.0 | — | — | — |
| Polyethylene oxide of MW 5,000,000 | — | — | — | — |
| Citric acid | — | — | — | 5.0 |
| Protease | 1.0 | 0.5 | 0.3 | 0.5 |
| Lipase | — | 0.4 | — | — |
| Amylase | 0.6 | 0.6 | 0.6 | |
| Zeolite A | — | — | 16.0 | 10.0 |
| Cellulase | 0.6 | 0.2 | — | 0.3 |
| SKS-6 | — | — | 10.0 | — |
| SRP | 0.1 | 0.1 | 0.1 | 0.1 |
| CMC | — | 0.3 | — | 0.5 |
| PVP | — | — | 0.1 | 0.2 |
| Silicone antifoam | 0.5 | 1.5 | 1.0 | 0.3 |
| Sodium sulfate | 0.0 | 3.0 | 0.0 | — |
| Balance (Moisture and Miscellaneous) | 100.0 | 100.0 | 100.0 | |
| Density (g/litre) | 800 | 600 | 700 | 850 |

EXAMPLE 3

The following are detergent formulations according to the present invention:

| | N | O | P | R |
|---|---|---|---|---|
| Agglomerate | | | | |
| QAS | 2.0 | — | 2.0 | — |
| MES | — | 2.0 | — | — |
| LAS (II) | 6.0 | — | — | — |
| C45AS | 6.0 | 4.0 | 2.0 | — |
| MBAS16.5, 1.9 | 4.0 | — | — | — |
| Zeolite A | — | 6.0 | 8.0 | 8.0 |
| Carbonate | 4.0 | 8.0 | — | 8.0 |
| MA/AA | 4.0 | 2.0 | 2.0 | 6.0 |
| CMC | 0.5 | 0.5 | 1.0 | 0.5 |
| DTPMP | 0.4 | 0.4 | — | 0.5 |
| Spray On | | | | |
| C25E3 | 1.0 | 1.0 | — | — |
| Perfume | 0.5 | 0.5 | 0.5 | 0.5 |
| Agglomerate | | | | |
| SKS-6 | 7.0 | 15.0 | 15.0 | 10.0 |
| LAS | 3.0 | 9.0 | 15.0 | 10.0 |
| Zeolite | 15.0 | — | — | — |
| C45 AS | — | 3.0 | — | — |

-continued

| | N | O | P | R |
|---|---|---|---|---|
| Dry Adds | | | | |
| LAS (I) | — | — | — | 15.0 |
| EDDS/HEDP | 0.5 | 0.3 | 0.5 | 0.8 |
| Zeolite A | 3.0 | 12.0 | 5.0 | 3.0 |
| NaSKS 6 | — | — | — | 11.0 |
| Citrate | — | 1.0 | — | — |
| Citric acid | 2.0 | — | 2.0 | 4.0 |
| NAC OBS | 4.1 | — | 5.0 | 4.0 |
| TAED | 0.8 | 2.0 | — | 2.0 |
| Percarbonate | 20.0 | 20.0 | 15.0 | 17.0 |
| SRP 1 | 0.3 | 0.3 | — | 0.3 |
| Protease | 1.4 | 1.4 | 1.0 | 0.5 |
| Lipase | 0.4 | 0.4 | 0.3 | — |
| Cellulase | 0.6 | 0.6 | 0.5 | 0.5 |
| Amylase | 0.6 | 0.6 | — | 0.3 |
| QEA | 1.0 | — | 1.0 | 1.0 |
| Silicone antifoam | 1.0 | 0.5 | 0.5 | 1.5 |
| Brightener 1 | 0.2 | 0.2 | — | 6.2 |
| Brightener 2 | 0.2 | — | 0.2 | — |
| Density (g/litre) | 850 | 850 | 800 | 775 |

What is claimed is:

1. A detergent composition comprising an aluminosilicate builder and an anionic surfactant and comprising (n) components (i), n being at least 2, whereby the level of aluminosilicate builder in said components together is at least 5% by weight of the composition and the level of the anionic surfactant in said components together is at least 5% by weight of the composition, and whereby the degree of mixture (M) of the anionic surfactant and the aluminosilicate builder is from 0 to 0.7, M being $$\Sigma^{n}_{i-1}\sqrt{(\sigma_1.\zeta_i)}$$

σ is the fraction of the anionic surfactant of the composition comprised in component (i);

ζ is the fraction of the aluminosilicate of the composition comprised in component (i) and wherein said aluminosilicate builder is in crystalline form and wherein said composition is phosphate-free, free of amorphous silicate, and substantially free of spray-on nonionic alkoxylated alcohol surfactants and further wherein at least one component is made by a spray-drying process and at least one component is made by an agglomeration process and wherein said component is a mixture of ingredients and each component represents a discrete part of the overall detergent composition.

2. A detergent composition according to claim 1 wherein M is from 0 to 0.65.

3. A detergent composition according to claim 1, wherein the components are particles having a weight average particle size of more than 150 microns.

4. A detergent composition according to claim 1, wherein said anionic surfactant comprises an alkyl sulphonate surfactant or an alkylsulphate surfactant, or mixtures thereof.

5. A detergent composition according to claim 1 comprising at least 10% by weight of aluminosilicate builder, whereby part of the aluminosilicate is not comprised in the components.

6. A detergent composition according to claim 1 wherein the components are free of sprayed-on nonionic alkoxylated alcohol surfactants.

7. A composition according to claim 1 wherein an effervescent system is present.

8. A composition according to claim 1 in granular form or in the form of a tablet.

9. A composition according to claim 1 comprising a hydrogen peroxide source and a bleach activator.

* * * * *